United States Patent [19]

Pounds

[11] 4,352,968

[45] Oct. 5, 1982

[54] ELASTOMERIC BOOT FOR A KEYBOARD SUBASSEMBLY

[75] Inventor: Walter R. Pounds, Lafayette, Colo.

[73] Assignee: KB Denver, Inc., Frederick, Colo.

[21] Appl. No.: 232,918

[22] Filed: Feb. 9, 1981

[51] Int. Cl.[3] ..... H01H 13/06

[52] U.S. Cl. ..... 200/302

[58] Field of Search ..... 200/302, 159 B, 5 A

[56] References Cited

U.S. PATENT DOCUMENTS

| | | | |
|---|---|---|---|
| 3,978,297 | 8/1976 | Lynn et al. | 200/302 |
| 3,995,126 | 11/1976 | Larson | 200/159 B |
| 4,046,975 | 9/1977 | Seeger, Jr. | 200/302 |
| 4,163,125 | 7/1979 | Boulanger | 200/302 |
| 4,237,351 | 12/1980 | Boulanger et al. | 200/159 B |
| 4,320,268 | 3/1982 | Brown | 200/5 A |
| 4,322,587 | 3/1982 | Burns et al. | 200/302 |

*Primary Examiner*—Willis Little

*Attorney, Agent, or Firm*—Lloyd L. Zickert

[57] ABSTRACT

An elastomeric boot for covering a keyboard subassembly and having a lip sealing means extending over and under the assembly to prevent entry of contaminants.

8 Claims, 7 Drawing Figures

FIG. 1
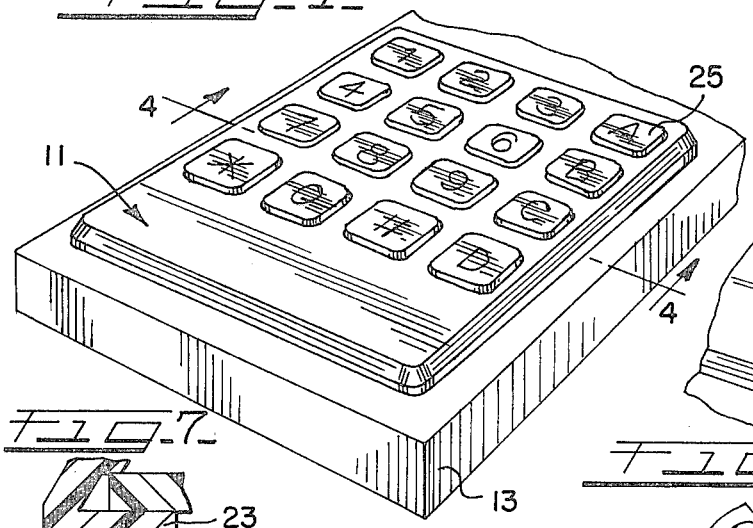
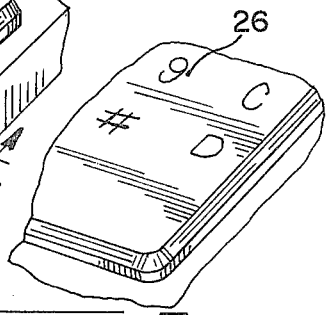
FIG. 7
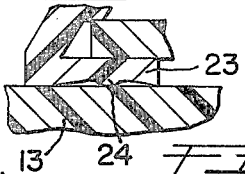
FIG. 5
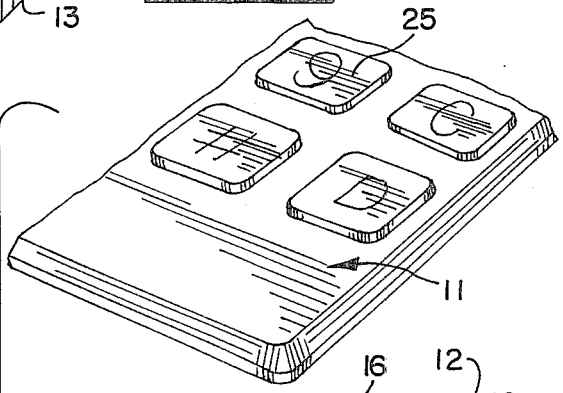
FIG. 3
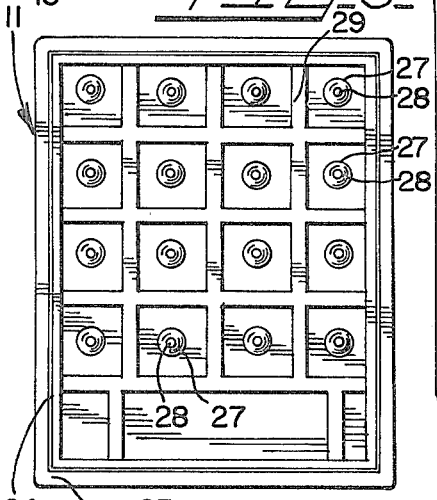
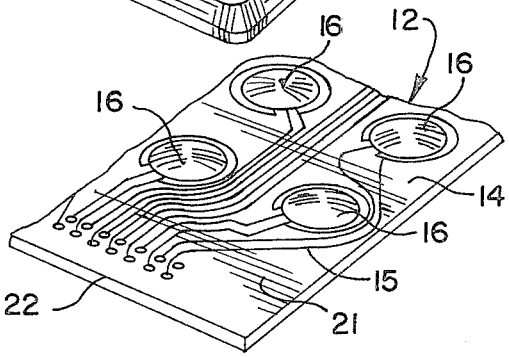
FIG. 6
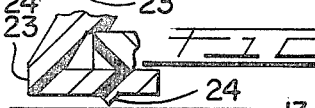
FIG. 4
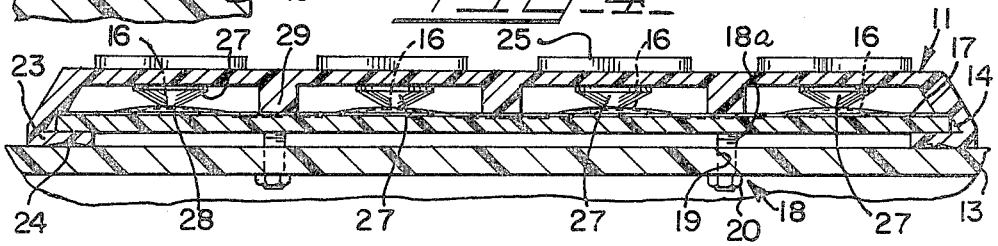
FIG. 2

ELASTOMERIC BOOT FOR A KEYBOARD SUBASSEMBLY

This invention relates in general to a keyboard assembly, and more particularly, to a cover member for a keyboard subassembly, and still more particularly to a boot capable of protecting and completely sealing the assembly against the entry of contaminants.

The use of keyboard assemblies of the type disclosed in U.S. Pat. No. 3,967,084, as well as other types for operating electrical circuitry, is well known.

The elements of such keyboard assemblies are highly sensitive to environmental contamination which can cause malfunction of the electrical components. For example, keyboard assemblies for marine or any outdoor use are particularly susceptible to wetness or water damage, while in a machine shop environment, grease is potentially disruptive to the operation of electrical switches. Chemical vapors and solutions in hospital and industrial laboratories can also interfere with the electrical functions of the assembly.

In order to protect against such harmful contaminants, it has been well known to use graphic overlays for keyboard assemblies. Generally, these overlays are made of hard plastic materials that only cover the upper surface and edges of the subassembly but do not extend beneath the lower face, thereby creating a peripheral opening between the keyboard assembly and the panel on which it is mounted through which contaminants can enter. Separate gaskets are available as an option to seal these keyboard assemblies to the mounting panel. If gaskets are not used, the assembly may not be sealed sufficiently against contaminants. The design of these overlays has not been effective in completely protecting the underside of the keyboard, the contacts or the outer face of the dome switches against the entry of contaminants.

Further, keys or buttons for actuating the dome switches are additional parts of the keyboard assembly used with these overlays and not part of the overlay itself. And the overlay will not restrict the force of key depression to one dome switch, thereby creating the possibility of crossover from the depressed dome switches to adjacent dome switches which will cause malfunction.

It is therefore an object of the present invention to overcome these deficiencies, and to provide a unique cover for completely sealing keyboard assemblies against contaminants.

A further object of this invention is to eliminate the need for separate sealing means by including a lip sealing means with a ridge on the lower surface thereof as an integral part of a one-piece boot of elastomeric material that sealingly engages the mounting panel.

Another object of this invention is to incorporate keys and dome switch actuators as an integral part of the boot to eliminate the necessity for separate keys in the subassembly.

A further object of this invention is in the provision of bar means extending from opposing edges of the boot to surround each dome switch, thereby preventing crossover from one dome to another and for strengthening the entire structure.

Other objects, features and advantages of the invention will be apparent from the following detailed disclosure, taken in conjunction with the accompanying sheet of drawings, wherein like reference numerals refer to like parts, in which:

FIG. 1 is a perspective view of a keyboard assembly mounted on a panel which includes the improved cover member of the invention;

FIG. 2 is an enlarged fragmentary exploded perspective view of a portion of the boot and the corresponding area of the keyboard subassembly that is covered by the boot;

FIG. 3 is a bottom plan view of the boot showing the bar means, dome switch actuators, and the continuous ridge on the lip sealing means;

FIG. 4 is a greatly enlarged detailed cross-sectional view taken substantially along line 4—4 of FIG. 1;

FIG. 5 is a fragmentary perspective view of a keyboard assembly having a modified cover member;

FIG. 6 is an exaggerated fragmentary cross-sectional view of the lip sealing means including the ridge sealing member positioned above the mounting panel; and FIG. 7 is an exaggerated fragmentary cross-sectional view of the lip sealing means and ridge in sealing contact with the panel.

Referring now to the drawings, and particularly to FIGS. 1 and 2, the boot of the invention, generally designated by the numeral 11 covers a keyboard subassembly 12 mounted on a panel 13.

The subassembly 12 includes a printed circuit board 14 with conductive paths 15 and dome switches 16 coacting with said paths. A sheet of Mylar or the like 17 with pressure sensitive adhesive on the side facing the board 14 overlies the dome switches and board to maintain the dome switches in proper alignment with the circuit paths and to electrically isolate the dome switches and paths, as illustrated in U.S. Pat. No. 3,967,084. Fastening means 18, as seen in FIG. 4, secures the assembly to a support panel 13. Said fastening means 18 may include studs 18*a* rigidly mounted on the circuit board 14 which would extend through holes 19 in the panel 13 and receive nuts 20 to draw the assembly tightly to the panel.

It may be appreciated that the boot 11 is a one-piece or unitary element of elastomeric material and shaped to cover the entire top face 21 and opposed edges 22 of the circuit board 14. The boot includes a peripheral lip 23 which extends under the edges of said board. The lip 23 includes a ridge 24 on the lower surface thereof that sealingly engages the support panel 13 upon tightening of the fastening means 17.

FIG. 6 illustrates the lip 23 including the ridge member 24 positioned above the panel 13. In order to provide a complete seal, it may be appreciated that the ridge 24 must engage the panel 13. Said seal is effected when the fastening means 17 are tightened to secure the subassembly to the panel causing the ridge 24 and lip 23 to coact in sealing contact with the support panel 13, as illustrated in FIG. 7. The ridge 24, by protruding from the surface of the lip 23, assures a sealing engagement between the boot and panel to prevent the entry of contaminants.

The upper surface of the boot 11 includes integral keys or buttons which may be raised as indicated at 25 in FIGS. 1 and 2, or may be flush as indicated at 26 in the modification of FIG. 5. While sixteen keys or buttons are shown in FIGS. 1 and 3, it may be appreciated that a greater or lesser number may be provided if so desired.

Said keys or buttons 25, 26 are arranged to align with the dome switches and depress said switches by means of dome actuating portions 27 which extend from the underside of the keys or buttons and include a flattened tip 28, as illustrated in FIGS. 3 and 4.

In FIGS. 3 and 4, the structure of the bar means 29 is illustrated. It includes integral bars extending between the opposing edges of and downward of the underside of the boot to a depth such that when the boot 11 is mounted on the subassembly 12, the bars engage the upper surface of the Mylar sheet 17 and therefore bear against the board in surrounding relation to each dome switch 16. This structure prevents transmittal of crossover action or force from one key to an adjacent key causing unintended activation of a dome switch should a key be depressed with an off-center force. It will be appreciated that this bar means 29 provides additional strength to the overall structure of the boot.

Accordingly, the one-piece elastomeric boot according to the present invention, when combined with the keyboard subassembly and tightly mounted on a panel, will prevent the entry of contaminants, thereby preventing malfunctioning caused by contaminants, while at the same time enhancing the overall operation of the assembly.

It will be understood that modifications and variations may be effected without departing from the scope of the novel concepts of the present invention, but it is understood that this application is to be limited only by the scope of the appended claims.

The invention is hereby claimed as follows:

1. In a keyboard assembly having a printed circuit board with conductive paths and dome switches coacting with said paths, and a cover member for said board, wherein said board includes fastening means for mounting the assembly on a support panel, the improvement being in the cover member which comprises an elastomeric boot overlying the board and sealing said board to said support panel against the entry of contaminants, said boot having coacting button and dome actuating portions aligned with said dome switches, and sealing means disposed peripherally of the board and between the board and panel.

2. The improvement of claim 1, wherein said dome actuating portions include flattened tip dome depression means for transmitting the force from depressed keys or buttons through the actuating portions to the aligned dome switch.

3. The improvement of claim 2, wherein said boot further includes bar means between the dome actuating portions for reinforcing the boot and preventing crossover movement between adjacent buttons.

4. The improvement of claim 3, wherein said lip sealing means includes a continuous ridge on the lower surface thereof that sealingly engages the support panel upon tightening of the fastening means.

5. The improvement of claim 4, wherein said button portions are raised.

6. The improvement of claim 4, wherein said button portions are flush.

7. In a keyboard assembly having a printed circuit board with conductive paths and dome switches coacting with said paths, and a cover member for said board, wherein said board includes fastening means for mounting the assembly on a support panel, the improvement being in the cover member which includes a body of elastomeric material coacting with the board to provide means for actuating said dome switches and means for sealing the board to the panel against contaminants, said body having a panel portion in parallel spaced relation to said board and a peripheral portion engaging the edges of the board and the support panel, said panel portion having buttons and dome actuating portions aligned with said dome switches, and said peripheral portion having sealing means disposed between the board and the panel.

8. The improvement defined by claim 7, wherein said body further includes bar means facing and engaging said board and disposed between said dome actuating portions for preventing the transmittal of crossover forces between adjacent buttons.

* * * * *